US005359980A

United States Patent [19]

Tomisawa

[11] Patent Number: 5,359,980

[45] Date of Patent: Nov. 1, 1994

[54] APPARATUS FOR CONTROLLING FUEL DELIVERY TO ENGINE ASSOCIATED WITH EVAPORATED FUEL PURGING UNIT

[75] Inventor: Naoki Tomisawa, Atsugi, Japan

[73] Assignee: Unisia Jecs Corporation, Atsugi, Japan

[21] Appl. No.: 136,403

[22] Filed: Oct. 15, 1993

[30] Foreign Application Priority Data

Oct. 16, 1992 [JP] Japan ..... 4-279037

[51] Int. Cl.[5] ..... F02M 33/02

[52] U.S. Cl. ..... 123/520; 123/478; 123/198 D

[58] Field of Search ..... 123/516, 518, 519, 520, 123/478, 480, 494, 704

[56] References Cited

U.S. PATENT DOCUMENTS

| | | | |
|---|---|---|---|
| 4,748,959 | 6/1988 | Cook et al. | 123/520 |
| 5,067,469 | 11/1991 | Hamburg | 123/520 |
| 5,090,388 | 2/1992 | Hamburg et al. | 123/520 |
| 5,176,123 | 1/1993 | Hosoda et al. | 123/520 |
| 5,215,061 | 6/1993 | Ogawa et al. | 123/520 |
| 5,216,995 | 6/1993 | Hosoda et al. | 123/520 |
| 5,216,997 | 6/1993 | Osanai et al. | 123/520 |
| 5,224,456 | 7/1993 | Hosoda et al. | 123/520 |
| 5,249,561 | 10/1993 | Thompson | 123/520 |

*Primary Examiner*—E. Rollins Cross
*Assistant Examiner*—Thomas N. Moulis
*Attorney, Agent, or Firm*—Foley & Lardner

[57] ABSTRACT

A fuel delivery control apparatus for use with an internal combustion engine having a throttle valve located in an induction passage for controlling the amount of air to the engine. The engine is associated with an evaporated fuel purging unit having a canister adapted to accumulate evaporated fuel from a fuel tank. A basic value of the amount of fuel metered to the engine is calculated based on the sum of the amount of air supplied to the engine through the throttle valve and the amount of air supplied to the engine from the canister. The basic value is corrected by subtracting the amount of evaporated fuel introduced from the canister to the engine from the calculated basic value. The fuel metered to the engine is controlled based on the corrected basic value.

4 Claims, 5 Drawing Sheets

APPARATUS FOR CONTROLLING FUEL DELIVERY TO ENGINE ASSOCIATED WITH EVAPORATED FUEL PURGING UNIT

BACKGROUND OF THE INVENTION

This invention relates to a fuel delivery control apparatus for use with an internal combustion engine associated with an evaporated fuel purging unit.

I t has been proposed to prevent leakage of evaporated fuel from a fuel tank to the exterior by employing an evaporated fuel purging unit of the type having a canister connected through a conduit to the fuel tank and also through a conduit to an engine induction passage. The canister contains adsorbent, such as activated charcoal, for absorbing or accumulating fuel evaporated in the fuel tank. The accumulated fuel is introduced from the canister to the engine under a vacuum pressure in the engine induction passage. With the conventional fuel delivery control apparatus, however, the evaporated fuel and air introduced into the engine from the canister have a great influence on the air-fuel ratio control.

SUMMARY OF THE INVENTION

It is a main object of the invention to provide an apparatus for controlling the fuel delivery to an internal combustion engine associated with an evaporated fuel purging unit which can provide accurate air-fuel ratio control unaffected by the evaporated fuel and air introduced in to the engine from the evaporated fuel purging unit.

There is provided, in accordance with the invention, a fuel delivery control apparatus for use with an internal combustion engine including a throttle valve located in an induction passage for controlling the amount of air supplied to the engine through the induction passage. The engine is associated with an evaporated fuel purging unit having a canister adapted to accumulate evaporated fuel from a fuel tank and a purge passage for connecting the canister to the induction passage at a position downstream of the throttle valve to introduce the evaporated fuel from the canister into the engine. The fuel delivery control apparatus comprises means for measuring a first value of the amount of air supplied to the engine through the throttle valve, means for measuring a second value of the amount of air supplied to the engine through the purge passage, means for calculating a basic value of the amount of fuel metered to the engine based upon the sum of the first and second values, means for measuring a third value of the amount of evaporated fuel supplied to the engine through the purge passage, means for subtracting the third value from the calculated basic value to correct the basic value, and means for controlling the amount of fuel metered to the engine based on the corrected basic value.

In another aspect of the invention, the fuel delivery control apparatus comprises sensor means provided in the induction passage upstream of the throttle valve for measuring a first value of the amount of air passing through the sensor means, means for connecting the canister and the fuel tank to the induction passage between the sensor means and the throttle valve so that the whole amount of air introduced into the canister and the fuel tank has passed the sensor means, means for calculating a basic value of the amount of fuel metered to the engine based upon the first value, means for measuring a second value of the amount of evaporated fuel supplied to the engine through the purge passage, means for subtracting the second value from the calculated basic value to correct the basic value, and means for controlling the amount of fuel metered to the engine based on the corrected basic value.

BRIEF DESCRIPTION OF THE DRAWINGS

The invention will be described in greater detail by reference to the following description taken in connection with the accompanying drawings, in which.

DETAILED DESCRIPTION OF THE INVENTION

Figure 1:
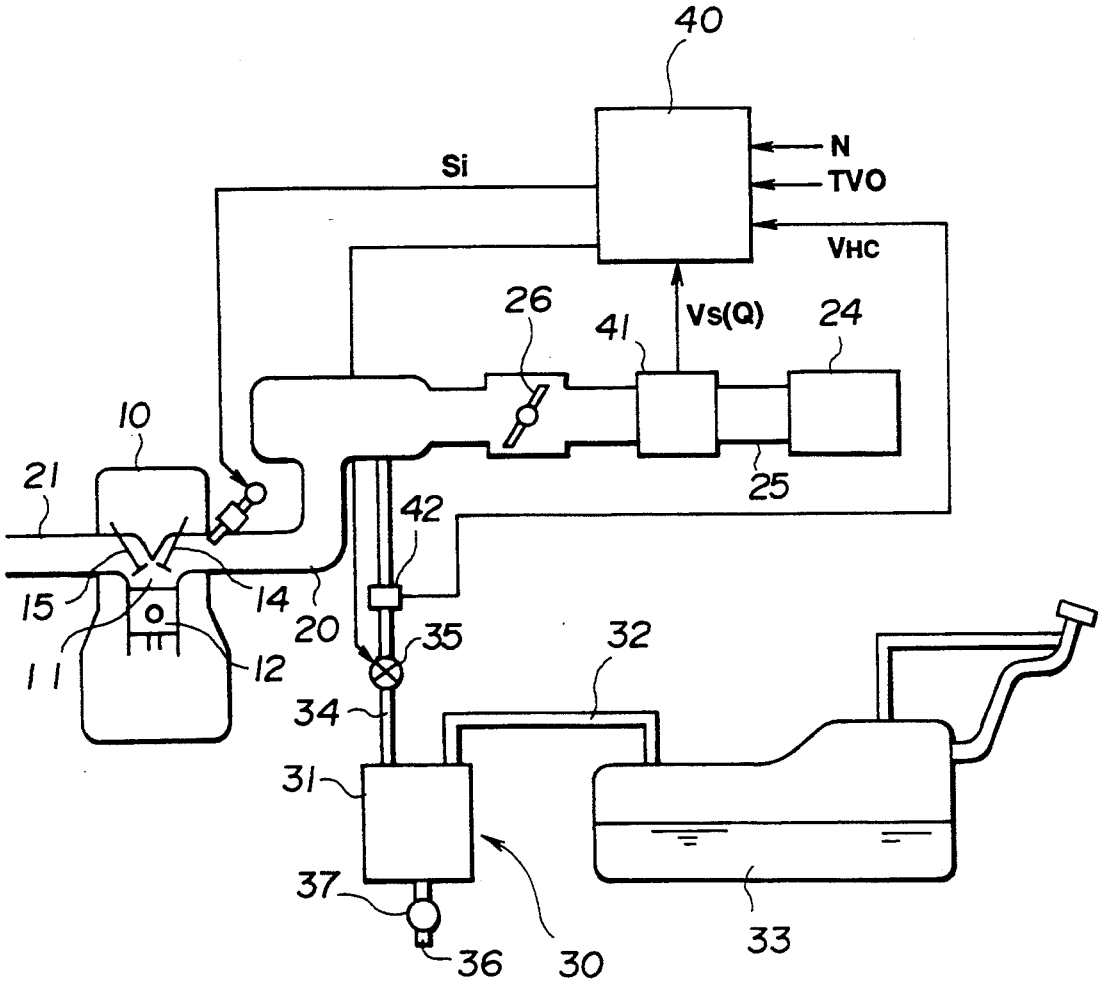
FIG. 1 is a schematic diagram showing one embodiment of a fuel delivery control apparatus made in accordance with the invention.

With reference to the drawings, and in particular to FIG. 1, there is shown a schematic diagram of a fuel delivery control apparatus embodying the invention. An internal combustion engine, generally designated by the numeral 10, for an automotive vehicle includes combustion chambers or cylinders, one of which is shown at 11. A piston 12 is mounted for reciprocal motion within the cylinder 11. A crankshaft (not shown) is supported for rotation within the engine 10 in response to reciprocation of the piston 12 within the cylinder 11.

An intake manifold 20 is connected with the cylinder 11 through an intake port with which an intake valve 14 is in cooperation for regulating the entry of combustion ingredients into the cylinder 11 from the intake manifold 20. A spark plug (not shown) is mounted in the top of the cylinder 11 for igniting the combustion ingredients within the cylinder 11 when the spark plug is energized by the presence of high voltage electrical energy. An exhaust manifold 21 is connected with the cylinder 11 through an exhaust port with which an exhaust valve 15 is in cooperation for regulating the exit of combustion products, exhaust gases, from the cylinder 11 into the exhaust manifold 21. The intake and exhaust valves are driven through a suitable linkage with the crankshaft.

A fuel injector 23 is mounted for injecting fuel into the intake manifold 20 toward the intake valve 14. The fuel injector 23 opens to inject fuel into the intake manifold 20 when it is energized by the presence of electrical signal Si. The length of the electrical pulse, that is, the pulse-width, applied to the fuel injector 23 determines the length of time the fuel injector 23 opens and, thus, determines the amount of fuel injected into the intake manifold 20.

Air to the engine 10 is supplied through an air cleaner 24 into an induction passage 25. The amount of air permitted to enter the combustion chamber 11 through the intake manifold 20 is controlled by a butterfly throttle valve 26 located within the induction passage 25. The throttle valve 26 is connected by a mechanical linkage to an accelerator pedal (not shown). The degree to which the accelerator pedal is depressed controls the degree of rotation of the throttle valve 26.

The engine 10 is associated with an evaporated fuel purging unit, generally designated by the numeral 30, which includes a canister 31 employing an adsorbent, such for example as activated charcoal, for accumulating or absorbing evaporated fuel (HC) introduced thereinto from a fuel tank 33. For this purpose, the canister 31 has an inlet port connected through an evaporated fuel passage 32 to the upper space of the fuel tank 33. The canister 31 also has an outlet port connected through a purge passage 34 to the induction passage 25 at a position downstream of the throttle valve 26. A purge control valve 35 is provided in the purge passage 34 for opening and closing the purge passage 34. The purge control valve 35 operates on a command from a control unit 40 to open and close the purge passage 34. The canister 31 has an air inlet port connected through an air passage 36 to the atmosphere. A check valve 37 is provided in the air passage 36 for permitting flow only toward the canister 31 while preventing back-flow. When the purge control valve 35 opens, a negative pressure is introduced from the in take passage 25 in to the canister 31. As a result, air is introduced through the air passage 36 to purge the evaporated fuel (HC) from the adsorbent provided in the canister 31. The purged fuel flows, along with the air, through the purge passage 34 into the in take passage 25.

The amount of fuel metered to the engine, this being determined by the width Ti of the electrical pulses Si applied to the fuel injector 23 is repetitively determined from calculations performed by the control unit 40, these calculations being based upon various conditions of the engine that are sensed during its operation. These sensed conditions include engine speed, throttle valve position, intake air flow, and purged fuel amount. Thus, a crankshaft position sensor, a throttle valve position sensor (now shown), an intake air flow meter 41, and a gas sensor 42 are connected to the control unit 40. The crankshaft position sensor is provided for producing a series of crankshaft position electrical pulses of a repetitive rate directly proportional to engine speed N. The throttle valve position sensor is a potentiometer associated with the throttle valve 26 and electrically connected in a voltage divider circuit for supplying a voltage proportional to the throttle valve position TVO. The flow meter 41 is located in the induction passage 25 at a position upstream of the throttle valve 26 to sense the air flow Q through the induction passage 25 and it produces a voltage signal Vs proportional thereto. The gas sensor 42 is provided in the purge passage 34 for supplying a voltage signal $V_{HC}$ corresponding to the amount of the evaporated fuel (HC).

The control unit 40 may employ a digital computer which includes a central processing unit (CPU), a read only memory (ROM), a random access memory (RAM), and an input/output control unit (I/O). The central processing unit communicates with the rest of the computer via data bus. The input/output control unit includes an analog-to-digital converter which receives analog signals from the flow meter and other sensors and converts them into digital form for application to the central processing unit which selects the input channel to be converted. The read only memory contains programs for operating the central processing unit and further contains appropriate data in look-up tables used in calculating appropriate values for fuel delivery requirement. A control word specifying the calculated fuel delivery requirement is periodically transferred by the central processing unit to the fuel-injection circuit included in the input/output control unit. The fuel injection control circuit converts the received control word into a fuel injection pulse signal Si for application to a power transistor which connects the fuel injector 23 to the car battery for a time period calculated by the digital computer.

Figure 2:
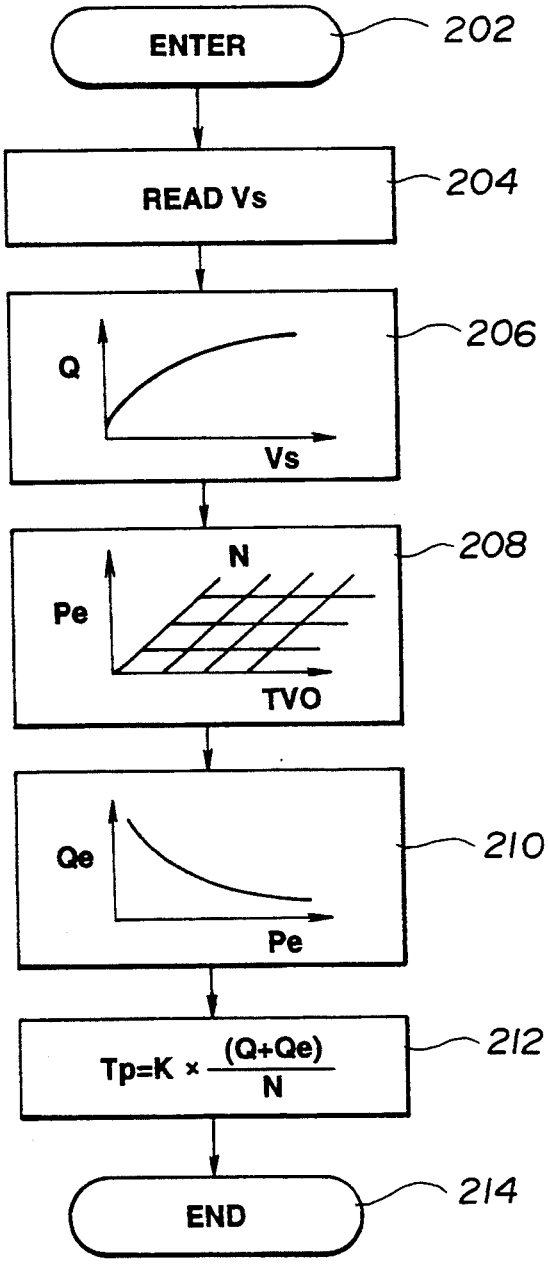
FIG. 2 is a flow diagram illustrating the programming of the digital computer as it is used to calculate a basic value of fuel delivery requirement.

FIG. 2 is a flow diagram illustrating the programming of the digital computer as it is used to calculate a basic value Tp of fuel delivery requirement. The computer program is entered at the point 202, for example, at uniform intervals. At the point 204 in the program, the voltage Vs outputted from the airflow meter 41 is read into the computer memory. At the point 206 in the program, the amount Q of air flow through the induction passage 25 is calculated from a relationship which specifies the intake air flow Q as a function of output voltage Vs. At the point 208 in the program, the negative pressure Pe produced in the intake passage 25 at a position downstream of the throttle valve 26 is calculated from a relationship which specifies the negative pressure Pe as a function of throttle valve position TVO and engine speed N. At the point 210 in the program, the amount Qe of air flow through the purge passage 34 is calculated from a relationship which defines the amount Qe as a function of intake manifold negative pressure Pe. It is to be noted that the amount Qe may be measured directly with the use of an airflow meter provided in the purge passage 34. In this case, the calculation step at the point 210 may be removed. At the point 212 in the program, the basic value Tp of fuel delivery requirement is calculated as $Tp=K1\times(Q+Qe)/N$ where K1 is a constant, Q is the calculated amount of air flow through the induction passage 25, Qe is the calculated amount of air flow through the purge passage 34, and N is the sensed engine speed. Following this, the program proceeds to the end point 214.

Figure 3:
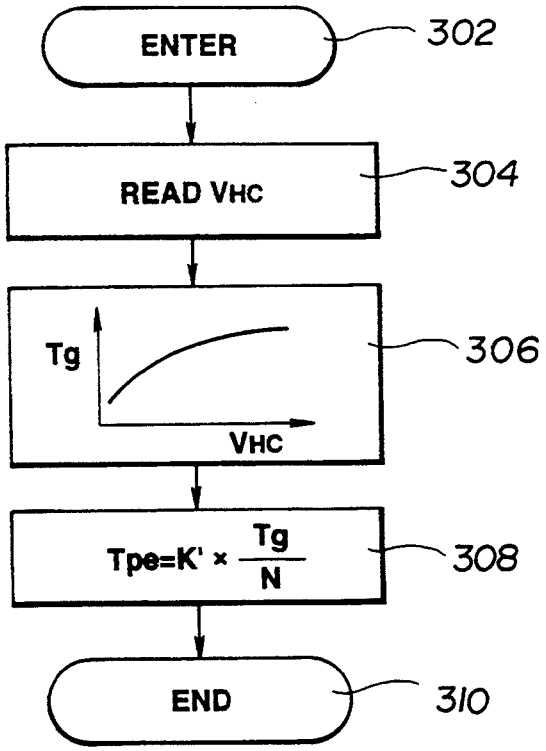
FIG. 3 is a flow diagram illustrating the programming of the digital computer as it is used to calculate an evaporated fuel amount.

FIG. 3 i s a flow diagram illustrating the programming of the digital computer as it is used to calculate the evaporated fuel amount Tpe. The computer program is entered at the point 302, for example, at a uniform intervals. At the point 304 in the program, the voltage $V_{HC}$ outputted from the gas sensor 42 is read into the computer memory. At the point 306 in the program, the amount Tg of evaporated fuel flow through the purge passage 34 is calculated from a relationship which specifies the evaporated fuel flow Tg as a function of output voltage $V_{HC}$. At the point 308 in the program, the evaporated fuel amount Tpe is calculated is calculated as $Tpe=K2\times Tg/N$ where K2 is a constant, Tg is the calculated evaporated fuel amount and N is the sensed engine speed. Following this, the program proceeds to the end point 310.

Figure 4:
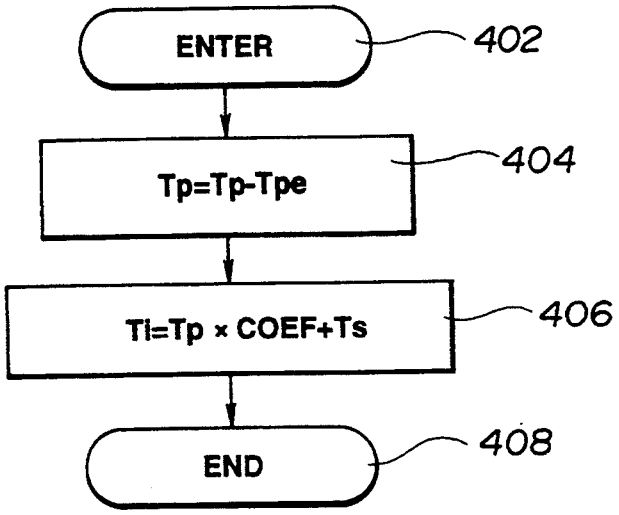
FIG. 4 is a flow diagram illustrating the programming of the digital computer as it is used to calculate a desired value of fuel delivery requirement.

FIG. 4 is a flow diagram illustrating the programming of the digital computer as it is used to calculate a desired value Ti of fuel delivery requirement. The computer program is entered at the point 402, for example, at uniform intervals. At the point 404 in the program, the corrected basic value Tp' of fuel delivery requirement is calculated as Tp'=Tp−Tpe where Tp is the basic fuel delivery requirement value calculated at the point 212 of FIG. 2 and Tpe is the evaporated fuel amount calculated at the point 308 of the flow diagram of FIG. 3. At the point 406 in the program, the desired value Ti of fuel delivery requirement is calculated as Ti=Tp='COEF+Ts where Tp' is the corrected basic fuel delivery requirement value calculated at the point 404 of the flow diagram of FIG. 4, Ts is a correction factor related to the voltage of the car battery, and COEF is a correction factor given as $$COEF=1+KTW+KMR+KAS+KAI+KFUEL$$

where KTW is a correction factor decreasing as the engine coolant temperature increases, KMR is a correction factor for providing fuel enrichment control under high engine load conditions, KAS is a correction factor for providing fuel enrichment control when the engine is cranking, KAI is a correction factor for providing fuel enrichment control when the engine is idling, and KFUEL is a correction factor for providing fuel enrichment control during acceleration. The control word specifying the desired fuel delivery requirement value Ti is transferred by the central processing unit to the fuel-injection control circuit. The fuel-injection control circuit converts it into a fuel injection pulse signal Si for application to the power transistor which connects the fuel injector 23 to the car battery for a time period calculated by the digital computer. Following this, the program proceeds to the end point 408.

Figure 5:
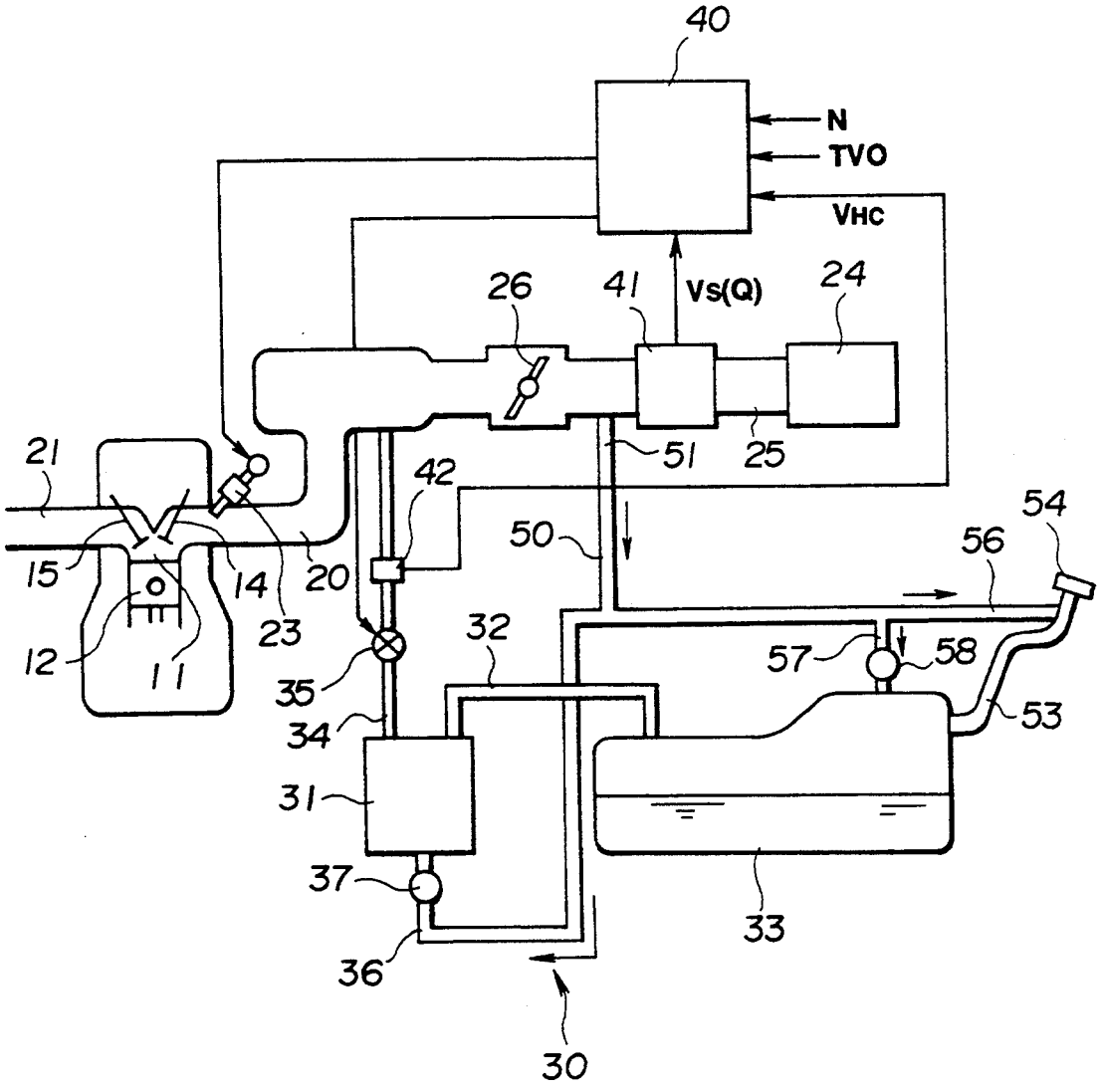
FIG. 5 is a schematic diagram showing a second embodiment of the fuel delivery control apparatus of the invention.

Referring to FIG. 5, there is illustrated a second embodiment of the fuel delivery control apparatus of the invention with the same elements being designated by the same reference numerals. The chief difference between the first and second embodiments is that the air passage 36 is connected through an air inlet passage 50 to the induction passage 25 at a position 51 between the airflow meter 41 and the throttle valve 26 rather than to the atmosphere. The fuel tank 33 has a fuel conduit 53 closed at its one end with a hermetically sealed cap 54. The fuel tank 33 is connected through an air passage 56 to the air inlet passage 50 and also through an air passage 57 to the air inlet passage 50. A check valve 57 is provided in the air passage 57 to permit flow toward the fuel tank 33 but not vice versa. In the second embodiment, the whole amount of air introduced into the canister 9 and the fuel tank 33 has passed the airflow meter 41.

Figure 6:
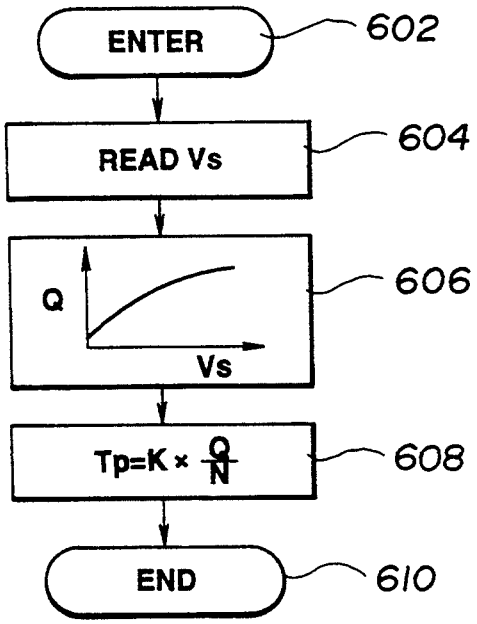
FIG. 6 is a flow diagram illustrating the programming of the digital computer as it is used to calculate a basic value of fuel delivery requirement.

FIG. 6 is a flow diagram illustrating the programming of the digital computer used in the control unit 40 to calculate a basic value Tp of fuel delivery requirement. The computer program is entered at the point 602, for example, at uniform intervals. At the point 604 in the program, the voltage Vs outputted from the airflow meter 41 is read into the computer memory. At the point 606 in the program, the amount Q of air flow through the induction passage 25 is calculated from a relationship which specifies the intake air flow Q as a function of output voltage vs. At the point 608 in the program, the basic value Tp of fuel delivery requirement as Tp=K3×Q/N where K3 is a constant, Q is the calculated amount of air flow through the induction passage 25, and N is the sensed engine speed. Following this, the program proceeds to the end point 610.

Since the whole amount of air introduced into the canister 31 and the fuel tank 33 has passed the airflow meter 41, the intake air flow Q measured by the airflow meter 41 corresponds to the whole amount of air introduced into the engine 10. For this reason, the basic fuel delivery requirement value is calculated based on the measured intake air flow Q.

The digital computer used in the control unit 40 is programmed to calculate the evaporated fuel amount Tpe in the same manner as described in connection with the flow diagram of FIG. 3. The evaporated fuel amount Tpe is used, along with the calculated basic fuel delivery requirement value Tp, to calculate the desired value Ti of fuel delivery requirement in the same manner as described in connection with the flow diagram of FIG. 4. The control word specifying the desired fuel delivery requirement value Ti is transferred by the central processing unit to the fuel-injection control circuit. The fuel-injection control circuit converts it into a fuel injection pulse signal Si for application to the power transistor which connects the fuel injector 23 to the car battery for a time period calculated by the digital computer.

Figure 7:
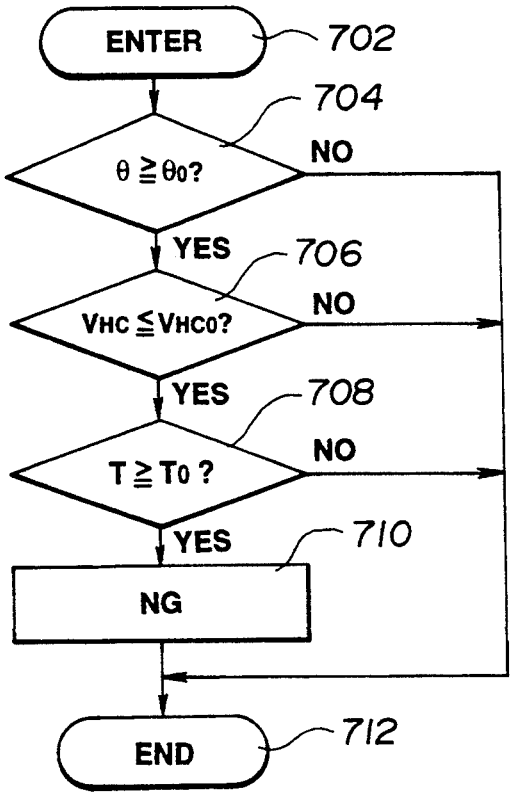
FIG. 7 is a flow diagram illustrating the programming of the digital computer as it is used to check a failure in the evaporated fuel purging unit.

FIG. 7 is a flow diagram illustrating the programming of the digital computer as it is used to check a failure in the evaporated fuel purging unit 30. The computer program is entered at the point 702, for example, at uniform intervals. At the point 704 in the program, a determination is made as to whether or not the degree $\theta$ to which the purge control valve 35 opens is equal to or greater than a predetermined value $\theta_0$. If the answer to this question is "yes", then the program proceeds to the point 706. Otherwise, the program proceeds to the end point 712. At the point 706 in the program, a determination is made as to whether or not the gas sensor output voltage $V_{HC}$ is equal to or less than a predetermined value $V_{HC0}$. If the answer to this question is "yes", then it means that almost no amount of evaporated fuel is purged in spite of the fact that the purge control valve 35 opens and the program proceeds to the point 708. Otherwise, the program proceeds to the end point 712. At the point 708 in the program, a determination is made as to whether or not the length T of time the gas sensor output voltage $V_{HC}$ remains equal to or less than the predetermined value $V_{HC0}$ exceeds a predetermined value $T_0$. If the answer to this question is "yes", then the program proceeds to the point 710 where an indication of a failure in the evaporated fuel purging unit 30 is provided and then to the end point 712. Otherwise, the program proceeds to the end point 712.

What is claimed is:

1. A fuel delivery control apparatus for use with an internal combustion engine including a throttle valve located in an induction passage for controlling the amount of air supplied to the engine through the induction passage, the engine being associated with an evaporated fuel purging unit having a canister adapted to accumulate evaporated fuel from a fuel tank and a purge passage for connecting the canister to the induction passage at a position downstream of the throttle valve to introduce the evaporated fuel from the canister into the engine, the fuel delivery control apparatus comprising:

means for measuring a first value of the amount of air supplied to the engine through the throttle valve;

means for measuring a second value of the amount of air supplied to the engine through the purge passage;

means for calculating a basic value of the amount of fuel metered to the engine based upon the sum of the first and second values;

means for measuring a third value of the amount of evaporated fuel supplied to the engine through the purge passage;

means for subtracting the third value from the calculated basic value to correct the basic value; and means for controlling the amount of fuel metered to the engine based on the corrected basic value.

2. The fuel delivery control apparatus as claimed in claim 1, further including means for measuring the length of time the third value remains equal to or less than a predetermined value, and means for providing an indication of a failure in the evaporated fuel purging unit when the measured time length exceeds a predetermined value.

3. A fuel delivery control apparatus for use with an internal combustion engine including a throttle valve located in an induction passage for controlling the amount of air supplied to the engine through the induction passage, the engine being associated with an evaporated fuel purging unit having a canister adapted to accumulate evaporated fuel from a fuel tank and a purge passage for connecting the canister to the induction passage at a position downstream of the throttle valve to supply the evaporated fuel from the canister to the engine, the fuel delivery control apparatus comprising:

sensor means provided in the induction passage upstream of the throttle valve for measuring a first value of the amount of air passing through the sensor means;

means for connecting the canister and the fuel tank to the induction passage between the sensor means and the throttle valve so that the whole amount of air introduced into the canister and the fuel tank has passed the sensor means;

means for calculating a basic value of the amount of fuel metered to the engine based upon the first value;

means for measuring a second value of the amount of evaporated fuel supplied to the engine through the purge passage;

means for subtracting the second value from the calculated basic value to correct the basic value; and means for controlling the amount of fuel metered to the engine based on the corrected basic value.

4. The fuel delivery control apparatus as claimed in claim 3, further including means for measuring the length of time the second value remains equal to or less than a predetermined value, and means for providing an indication of a failure in the evaporated fuel purging unit when the measured time length exceeds a predetermined value.

* * * * *